US012345153B2

(12) United States Patent
Charara et al.

(10) Patent No.: US 12,345,153 B2
(45) Date of Patent: Jul. 1, 2025

(54) DISTRIBUTED FIBER-OPTIC TELEMETRY FOR DATA TRANSMISSION AND REAL-TIME LOCATION OF DOWNHOLE AUTONOMOUS SENSING DEVICES

(71) Applicant: SAUDI ARABIAN OIL COMPANY, Dhahran (SA)

(72) Inventors: Marwan Charara, Moscow (RU); Anton Egorov, Moscow (RU); Anton Gryzlov, Moscow (RU); Huseyin Seren, Houston, TX (US); Max Deffenbaugh, Houston, TX (US)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/263,096

(22) PCT Filed: Aug. 12, 2022

(86) PCT No.: PCT/RU2022/000253
§ 371 (c)(1),
(2) Date: Jul. 26, 2023

(87) PCT Pub. No.: WO2024/035271
PCT Pub. Date: Feb. 15, 2024

(65) Prior Publication Data
US 2025/0020057 A1 Jan. 16, 2025

(51) Int. Cl.
*E21B 47/12* (2012.01)
*E21B 47/135* (2012.01)
(Continued)

(52) U.S. Cl.
CPC ..... *E21B 47/135* (2020.05); *E21B 47/138* (2020.05); *E21B 47/16* (2013.01)

(58) Field of Classification Search
None
See application file for complete search history.

(56) References Cited

U.S. PATENT DOCUMENTS 7,994,932 B2 8/2011 Huang et al.
9,557,195 B2 1/2017 Barfoot et al.
(Continued)

OTHER PUBLICATIONS

G. Feo et al., "Distributed Fiber Optic Sensing for Real-Time Monitoring of Gas in Riser during Offshore Drilling", Sensors, 2020, vol. 20, No. 1, pp. 266-267 (16 pages).

*Primary Examiner* — Curtis A Kuntz
*Assistant Examiner* — Jerold B Murphy
(74) *Attorney, Agent, or Firm* — Osha Bergman Watanabe & Burton LLP

(57) ABSTRACT

A system and method for using a Distributed Acoustic Sensor (DAS) system to receive signals transmitted from remote autonomous sensors and to locate the autonomous sensors are disclosed. The method includes installing a DAS system in a borehole consisting of at least one fiber-optic cable connected to at least one corresponding interrogator, deploying at least one autonomous sensor and conducting at least one measurement. The methods also include encoding the at least one measurement in at least one encoded acoustic signal, transmitting the at least one encoded acoustic signal to the at least one fiber-optic cable, and detecting the at least one encoded acoustic signal with the DAS system. Furthermore, the methods include recording the at least one encoded acoustic signal received by the DAS system at a surface location and processing the at least one encoded acoustic signal with a processing unit to decode and obtain the at least one measurement.

18 Claims, 6 Drawing Sheets

(51) Int. Cl.
*E21B 47/14* (2006.01)
*E21B 47/16* (2006.01)

(56) References Cited

U.S. PATENT DOCUMENTS

| | | | | |
|---|---|---|---|---|
| 9,715,031 | B2 | 7/2017 | Contant et al. | |
| 9,804,021 | B2 | 10/2017 | Farhadiroushan et al. | |
| 9,823,373 | B2 | 11/2017 | Skinner | |
| 10,100,635 | B2 | 10/2018 | Keller et al. | |
| 10,202,845 | B2 | 2/2019 | Lee et al. | |
| 10,487,647 | B2 | 11/2019 | Song et al. | |
| 10,591,623 | B2 | 3/2020 | Jaaskelainen et al. | |
| 10,598,810 | B2 | 3/2020 | Mandviwala et al. | |
| 10,711,599 | B2 | 7/2020 | Jaaskelainen et al. | |
| 10,900,351 | B2 * | 1/2021 | Deffenbaugh | E21B 47/12 |
| 2017/0167249 | A1 * | 6/2017 | Lee | E21B 43/128 |
| 2018/0266240 | A1 * | 9/2018 | Jaaskelainen | E21B 49/08 |
| 2018/0328170 | A1 * | 11/2018 | Jaaskelainen | E21B 47/07 |
| 2020/0040001 | A1 | 2/2020 | Dai et al. | |
| 2022/0082726 | A1 | 3/2022 | Sarkar | |
| 2022/0228458 | A1 * | 7/2022 | Jaaskelainen | E21B 33/1208 |
| 2024/0012168 | A1 * | 1/2024 | Singh | G01V 1/282 |

* cited by examiner

DISTRIBUTED FIBER-OPTIC TELEMETRY FOR DATA TRANSMISSION AND REAL-TIME LOCATION OF DOWNHOLE AUTONOMOUS SENSING DEVICES

BACKGROUND

Fiber-optic cables are commonly used for data transmission from remote sensors. In most cases, the fiber is directly connected to the sensing device, and the sensing device generates optical signals to be sent through the fiber. Recently, new fiber-optic technologies have enabled the sensing of certain physical properties through the fiber itself, e.g., distributed acoustic sensor (DAS) systems for acoustic field recording, distributed temperature sensor (DTS) systems for temperature, etc.

Existing technologies for data transmission and telemetry of downhole devices in a well include retrieval of the data by other devices lowered into the borehole or placing a plurality of wireless nodes inside the borehole which communicate with each other and the surface in a multi-hop fashion. Fiber-optic cables offer the possibility to directly record acoustic signals transmitted from devices in the borehole, as well as to locate them.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments related to methods for using a DAS system to receive signals transmitted from remote autonomous sensors and to locate the autonomous sensors. The methods include installing a DAS system in a borehole consisting of at least one fiber-optic cable connected to at least one corresponding interrogator, deploying at least one autonomous sensor, and conducting at least one measurement. The methods also include encoding the at least one measurement in at least one encoded acoustic signal, transmitting the at least one encoded acoustic signal to the at least one fiber-optic cable, and detecting the at least one encoded acoustic signal with the DAS system. Furthermore, the methods include recording the at least one encoded acoustic signal received by the DAS system at a surface location and processing the at least one encoded acoustic signal with a processing unit to decode and obtain the at least one measurement.

In general, in one aspect, embodiments related to a non-transitory computer readable medium storing instructions executable by a computer processor with functionality for conducting at least one measurement by at least one autonomous sensor, encoding the at least one measurement in at least one encoded acoustic signal, and transmitting the at least one encoded acoustic signal from the at least one autonomous sensor to at least one fiber-optic cable of a DAS system. The instructions further include detecting the at least one encoded acoustic signal with the DAS system, recording the at least one encoded acoustic signal received by the DAS system at a surface location, and processing the at least one encoded acoustic signal with a processing unit to decode and obtain the at least one measurement conducted by the at least one autonomous sensor and at least one location of the at least one autonomous sensor.

In general, in one aspect, embodiments related to a system including a DAS system including a first fiber-optic cable installed in a borehole and connected to a first corresponding interrogator, the DAS system being configured to record at least one encoded acoustic signal deforming a fiber in the first fiber-optic cable. The system also includes a DTS system consisting of a second fiber-optic cable installed in a borehole connected to a second corresponding interrogator, the DTS system being configured to record a temperature. The system further includes at least one autonomous sensor consisting of an acoustic transmitter and being configured to conduct at least one measurement in the borehole, wherein the acoustic transmitter transmits an encoded acoustic signal consisting of the at least one measurement to the DAS system. The system further includes a processing unit configured to demodulate/decode the at least one encoded acoustic signal and obtain at least one measurement conducted by the at least one autonomous sensor and at least one location of the at least one autonomous sensor.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
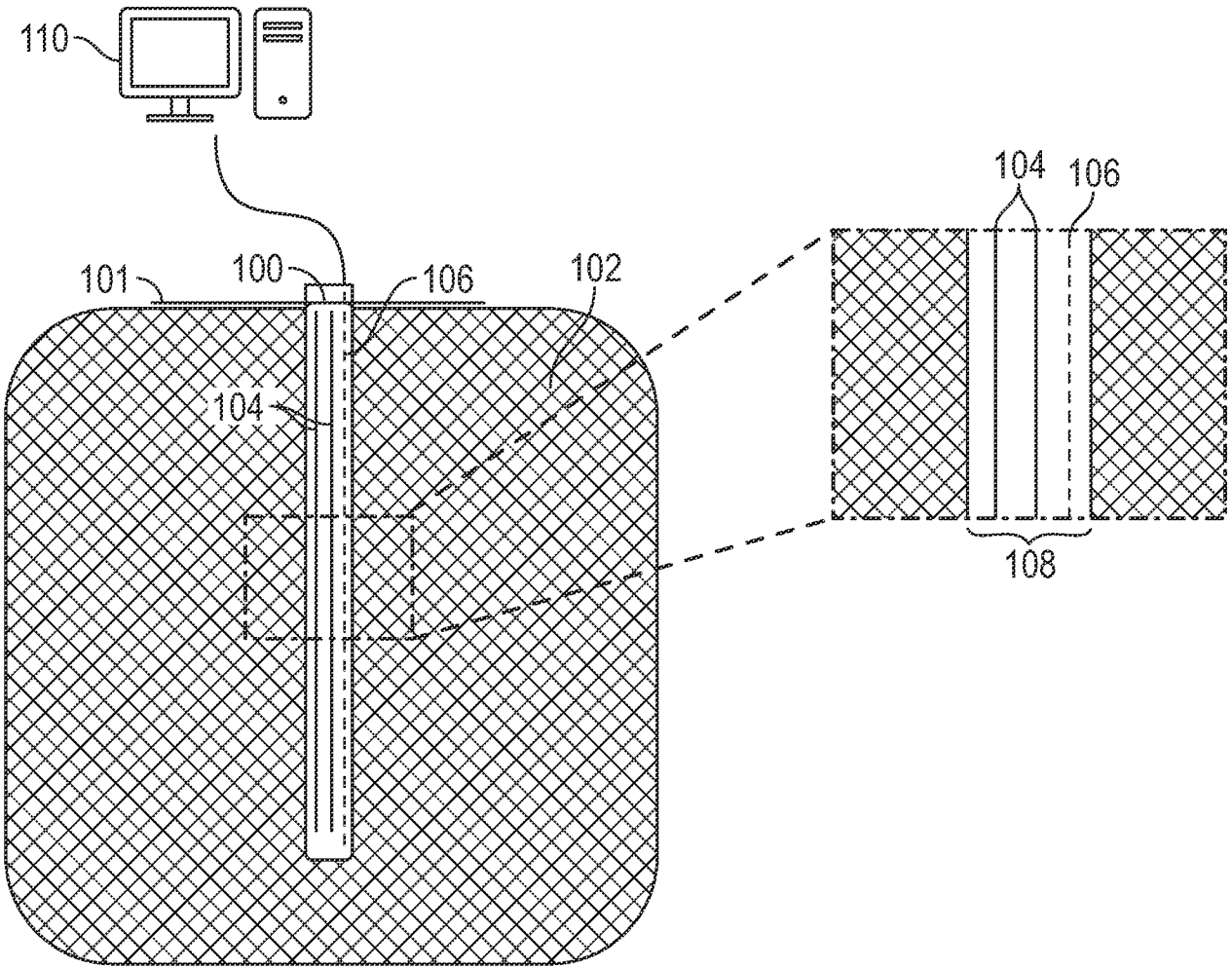
FIG. 1 shows a well with casing and a fiber-optic cable according to one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before," "after," "single," and other such terminology. Rather, the use of ordinal numbers is to distinguish between the elements. By way of an example, a first element is distinct from a second element, and the first element may encompass more than one element and succeed (or precede) the second element in an ordering of elements.

In the following description of FIGS. 1-6, any component described regarding a figure, in various embodiments disclosed herein, may be equivalent to one or more like-named components described with regard to any other figure. For brevity, descriptions of these components will not be repeated regarding each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

It is to be understood that the singular forms "a," "an," and "the" include plural referents unless the context clearly dictates otherwise. Thus, for example, reference to "an autonomous sensor" includes reference to one or more of such autonomous sensors.

Terms such as "approximately," "substantially," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

It is to be understood that one or more of the steps shown in the flowcharts may be omitted, repeated, and/or performed in a different order than the order shown. Accordingly, the scope disclosed herein should not be considered limited to the specific arrangement of steps shown in the flowcharts.

Embodiments disclosed herein relate to a system and a method for using a DAS system to receive signals transmitted from remote autonomous sensors not connected to the cable and to locate the autonomous sensors. In some embodiments, the system includes one or multiple deployed fiber-optic cables (cemented in the annulus behind the casing, attached to the production tubing, hanging in the wellbore, etc.) connected to one of multiple DAS/DTS interrogators, one or multiple autonomous sensors equipped with acoustic transmitters, and a processing unit on the surface.

In one or more embodiments, the method includes deploying the autonomous devices in a borehole where they conduct measurements, encode the measurements, and transmit them as acoustic waves. Using the DAS system, the encoded signals are recorded when they deform the deployed fiber-optic cables and transmitted to the surface. On the surface, the processing unit separates the encoded signals of the autonomous sensors from the background acoustic field and from each other, applies an algorithm for sensor localization, and demodulates the signals to obtain the measurements of each individual autonomous sensor. A DTS system is optionally used for additional sensor depth determination by matching the temperature profiles recorded by the DTS system and the autonomous sensors.

FIG. 1 illustrates systems in accordance with one or more embodiments. Specifically, FIG. 1 shows a well (100) that may penetrate the subsurface (102). The well (100) may be composed of a borehole (108) that may be drilled from the surface of the earth (101) into the subsurface (102). The borehole (108) may be cased with casing (104) disposed within the borehole (108). Casing (104) is a pipe or a sequence of pipes, typically steel pipe designed to resist compressive and tensile stresses in the subsurface (102). A fiber-optic cable (106) may be installed within the well (100). In some embodiments the fiber-optic cable (106) may be disposed in the annulus between the wall of the borehole (108) and the casing (104), while in other embodiments (not shown) the fiber-optic cable (106) may be disposed inside the casing (104). On the surface of the earth (101) one end of the fiber-optic cable (106) may be connected to a laser source and optical interrogator (110) configured to form a distributed acoustic sensor (DAS) system.

Figure 2:
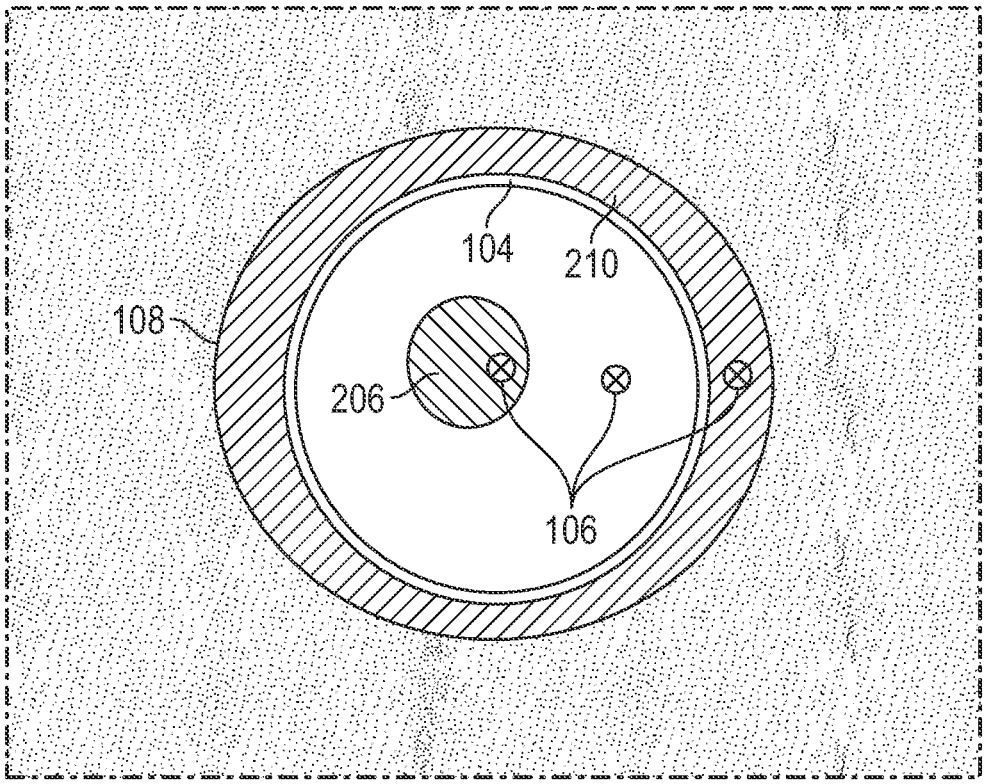
FIG. 2 shows a cross section of a well according to one or more embodiments.

FIG. 2 shows a cross-section of a well (100), in accordance with one or more embodiments. Casing (104) may be installed within a borehole (108) and cement (210) may fill the space in the annulus between the wall of the borehole (108) and the casing (104). Inside the casing (104) production tubing (206) may be disposed. In some embodiments, a fiber-optic cable (106) may be disposed inside the production tubing (206). In other embodiments, the fiber-optic cable (106) may be disposed in the annulus between the production tubing (206) and the casing (104). In still further embodiments, the fiber-optic cable (106) may be disposed in the annuus between the casing (104) and the wall of the borehole (108). The locations of the fiber-optic cable (106) within the cross-section of the well (100) are provided as illustrations only and should not be interpreted as limiting the scope of embodiments disclosed herein.

Fiber-optic cables (106) are widely used for sensor data transmission in various domains. Sensors may be directly connected to the fiber-optic cable (106) and generate optical signals that transmit sensor measurements through the fiber. When used in this way, the measurements obtained by the sensors are modulated onto a carrier wave of light and transmitted through the fiber-optic cable (106) to a receiver that decodes the signals.

Another way to obtain information with a fiber-optic cable (106) is to use the cable itself as a sensor. In one or more embodiments, a fiber-optic cable (106) is used to detect an acoustic field as a way to transmit information from downhole devices to the surface (101) without the need for a direct connection from the surface (101) to the devices. In this case, the downhole device may encode the digitally recorded data using a modulation technique and transmit it as an acoustic wave via an acoustic transmitter installed in the downhole device or sensor. The interrogator (110) generates light pulses that travel down the length of the fiber-optic cable (106), emitting backscattered signals before being reflected back to the interrogator (110) from the end of the fiber-optic cable (106). The DAS system comprises the fiber-optic cable (106) along with the interrogator (110); it records the acoustic signal using the installed fiber and transmits it to the surface (101) where it can be demodulated by the interrogator (110) to obtain the recordings of the downhole device or sensor. Any downhole device or sensor installed inside the well (100) (e.g., valves, pumps) and instrumented with an acoustic transmitter may act as a measurement tool and transmit data to the interrogator (110) through the fiber-optic cable (106).

Rayleigh backscattering is one type of scattering that occurs when scattering locations distributed throughout the fiber-optic cable (106) reflect the input light signals back to the interrogator (110). The interrogator (110) measures changes in the phase, wavelength, and intensity of the backscattered light signals. Changes in wavelength may be used to measure changes in temperature in the fiber-optic cable (106). Changes in intensity may be used to detect changes in pressure. Changes in the phase of backscattered light signals may be indicative of strain in the fiber-optic cable (106). Continuously measuring the change in strain throughout the fiber-optic cable (106) may allow it to be used as a detector of acoustic signals impinging upon it.

Other scattering effects can be used to obtain data from a fiber-optic cable (106): Brillouin scattering occurs when acoustic phonons traveling within the fiber-optic cable (106) interact with the input light signal. The backscattered signals from Brillouin scattering are much weaker than those from Rayleigh backscattering and require summing multiple backscattered signals related to the same event to obtain an accurate measurement. This limits applicability of the method to frequencies up to a few tens of Hertz. However, Brillouin scattering allows for measurements of the absolute value of temperature—something that Rayleigh scattering cannot do. Raman backscattering occurs when light is scattered at the molecular spatial scale. Raman backscattered signals are even weaker than those from Brillouin scattering and require summing signals over many seconds. This limits the applicability of this technique solely to measuring the absolute value of temperature.

A fiber-optic cable (106) may be of any conventional type, which always has intrinsic backscattering, or the fiber-optic cable (106) may be engineered in a specific way, for example, with Bragg gratings (capable of selectively reflecting and transmitting certain wavelengths of light). The fiber-optic cable (106) can be straight or shaped in various manners, e.g., helical. Embedding the fiber-optic cable (106) within the casing (104) or tubing of a well (100) allows it to be used as a downhole sensor for continuous measurement of acoustic signals and other physical properties (e.g., temperature, pressure, and strain) within the borehole (108).

Figure 3:
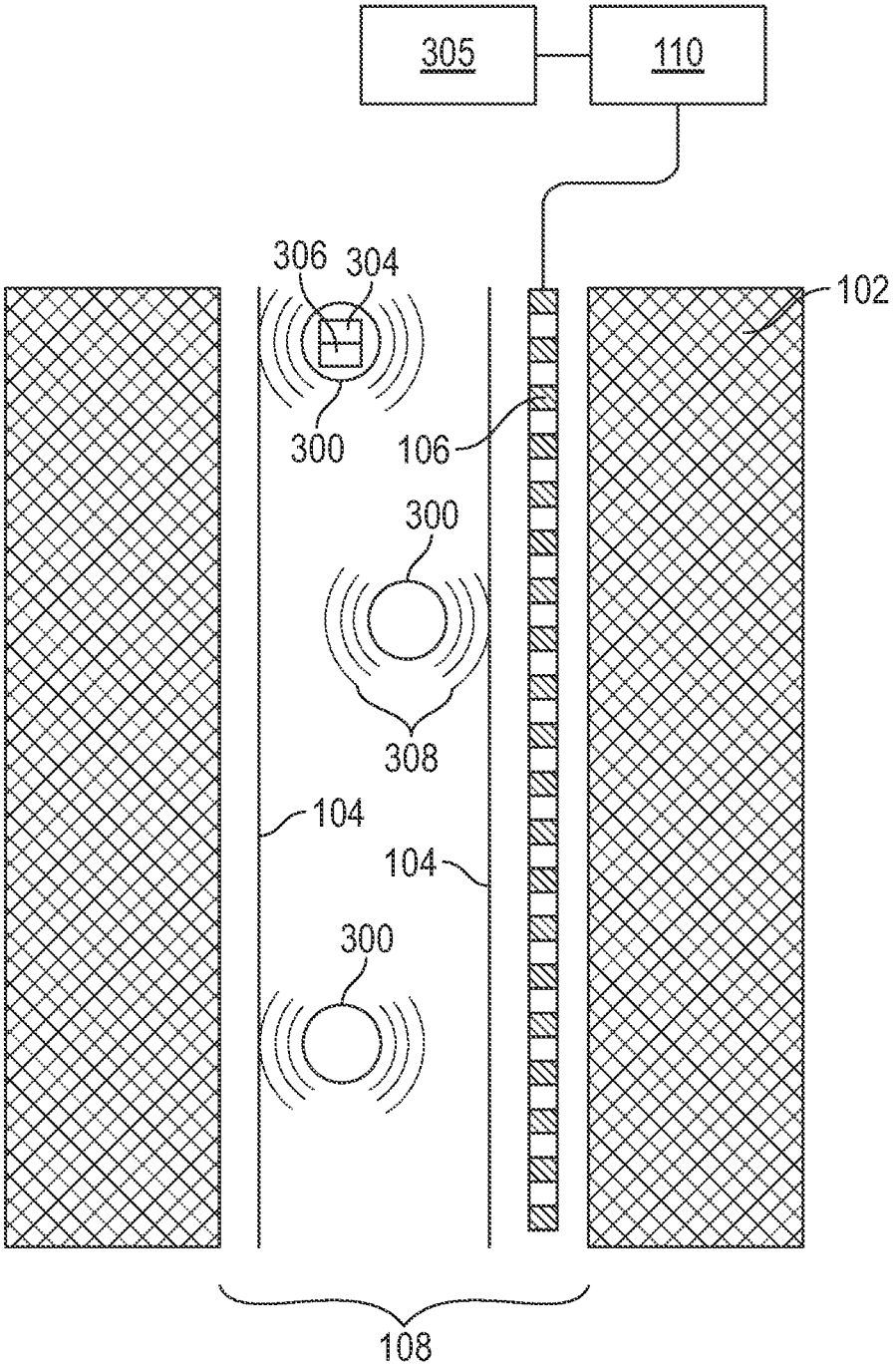
FIG. 3 shows autonomous sensors in a borehole with casing and a fiber-optic cable according to one or more embodiments.

FIG. 3 illustrates the fiber-optic cable (106) and an autonomous sensor (300) telemetry positioning system in the well (100). Autonomous sensors (300) are completely wireless and designed for autonomous measurements. The telemetry positioning system comprises a plurality of autonomous sensors (300), each with internal memory and powered by a battery. These autonomous sensors (300) may be placed inside a well (100), sink due to gravity, conduct measurements, and record the measurements in the internal memory until they reach a specified depth. The autonomous sensors (300) are not connected to the surface (101) and float inside the borehole (108). In one or more embodiments, the autonomous sensors (300) may have means for independent movement (e.g., propellers, deployable weights). The autonomous sensors (300) may travel back to the surface (101) to download their recordings, but this procedure entails a delay between the time when the measurements are recorded and the time when they are available for analysis.

In the embodiment in FIG. 3, the fiber-optic cable (106) is installed between the casing (104) and the borehole (108), however, it may be installed in other locations within the borehole (108), as mentioned above. Having the fiber-optic cable (106) deployed within the borehole (108) allows it to be used as part of the telemetry positioning system. The autonomous sensors (300) contain a sensing block (304), which contains various sensors and a battery. The sensors in the sensing block (304) may include, but are not limited to, sensors of pressure, temperature, magnetic/electrical/acoustic fields, and other physical or chemical properties in the well (100) or in the subsurface (102). The autonomous sensors (300) also contain a data transmission block (306), which comprises an encoding module that transforms and encodes the measurements from the sensing block (304) and, optionally, each autonomous sensor's (300) unique identification number and timestamp of its internal clock into an encoded/modulated form, preparing the measurements for data transmission. The data transmission block (306) also includes an acoustic transmitter, which transmits the signals in the encoded/modulated form as acoustic waves (308). A modulation technique of choice can be used by the encoding module, including, but not limited to various types of frequency shift keying, phase shift keying, or amplitude shift keying. In one or more embodiments, the acoustic transmitter may be a piezo device that is potted in an elastomer for insulation and impedance matching to the fluids in the well (100).

Acoustic waves (308) emitted by the autonomous sensors (300) deform the fiber-optic cable (106) and are thereby detected by the interrogator device (110), which continuously sends the light pulses through the fiber-optic cable (106) and reconstructs the fiber deformations through analysis of the reflected light. The interrogator (110) outputs the recordings of fiber deformation in time and passes them to the processing unit (305).

Inside the processing unit (305), there are optional processing steps devoted to the separation of the modulated signals generated by the autonomous sensors (300) from each other as well as from the background acoustic noise recorded by the fiber-optic system. These steps can be carried out by a machine-learning system trained in advance using data collected in the field or simulated data. The machine-learning system can be based on neural networks of different types, but not limited to the following: multilayer perceptron, convolutional neural networks, recurrent neural networks, transformer networks. After the optional separation procedure, the processing unit conducts demodulation of the identified signals to obtain each autonomous sensors' (300) recordings. In one or more embodiments, the machine-learning system may be trained using synthetic or semi-synthetic datasets. Two separate datasets are created—one of the datasets consists of samples of acoustic noise measured in the borehole (108), and another dataset consists of clean samples of encoded sensor signals (which can be measured or synthetically generated). The training dataset is then created by weighted summation of acoustic noise samples with the clean encoded sensor signals, and the clean sensor signals without acoustic noise act as targets/labels. In this case, the task of the machine-learning system is to remove the borehole noise and is similar to machine-learning-based noise removal methods for images. The separation of different autonomous sensor (300) signals from each other may also be performed by machine learning algorithms and is similar to the procedure of separation of different sources' signals in seismic exploration, so-called 'deblending.'

As the autonomous sensor (300) is not connected to the surface (101), its location is not available in real-time and it is necessary to perform a positioning procedure. If located in the well (100), the autonomous sensor (300) can measure the pressure and transmit it to the surface (101) through the described fiber-optic telemetry system, which allows for estimating the autonomous sensor's (300) location in the well (100) from the recorded pressure of the liquid column above it. Alternatively, depth can be determined based on a matching of the temperature profiles measured by the untethered autonomous sensor (300) and an optionally installed DTS. Furthermore, a more accurate estimate of the autonomous sensors' (300) locations can be obtained from the analysis of the DAS system recordings at any given time—for example, in the well (100), such localization can be performed by computation of the acoustic energy envelope along the fiber at any given moment and analysis of the amplitudes of the envelope. A simple estimate of an autonomous sensor's (300) location can be obtained by identifying the energy envelope maxima above a certain threshold. Additionally, the average velocity of the multiphase fluid in the well (100) can be estimated by computing the cross-correlation of a fiber-optic signal at two moments in time.

The data recorded by the autonomous sensors (300), its modulation and transmission through acoustic waves (308) to the fiber-optic cable (106), and its subsequent transmission through fiber to the surface (101) allow for almost real-time data transmission from the autonomous sensors (300) to the surface (101) and the localization of the autonomous sensors (300). Together with the recordings, each autonomous sensor (300) may transmit its unique identification number, its internal clock time, or other metadata. The following options can be realized:

a) The transmission blocks (306) can be programmed to send the data at specific time intervals, determined based on the spatial resolution of the fiber-optic system and the expected movement speed of the autonomous sensor (300).

b) The sensor can be programmed to send the data based on its internal depth estimation based on hydrostatic pressure.

The sensor can send all of the measurements recorded during the last interval at a single time. The depths may be assigned by interpolation based on the current and previous depth identified by the DAS system.

The sensor can send an average of the measurements recorded within the last interval.

The sensor records many measurement points but sends only the last datapoint at each interval. The rest of the recorded data are available after the sensor returns to the surface (101). The depths are assigned by interpolation.

c) The sensor can be programmed to send the data after each measurement.

Sending data in batches using the methods above allows for preserving the energy in a battery-operated untethered tool. Performing the system location determination by an external system such as DAS allows for removing internal depth estimation devices from the autonomous sensors (300), thus allowing further miniaturization.

Figure 4:
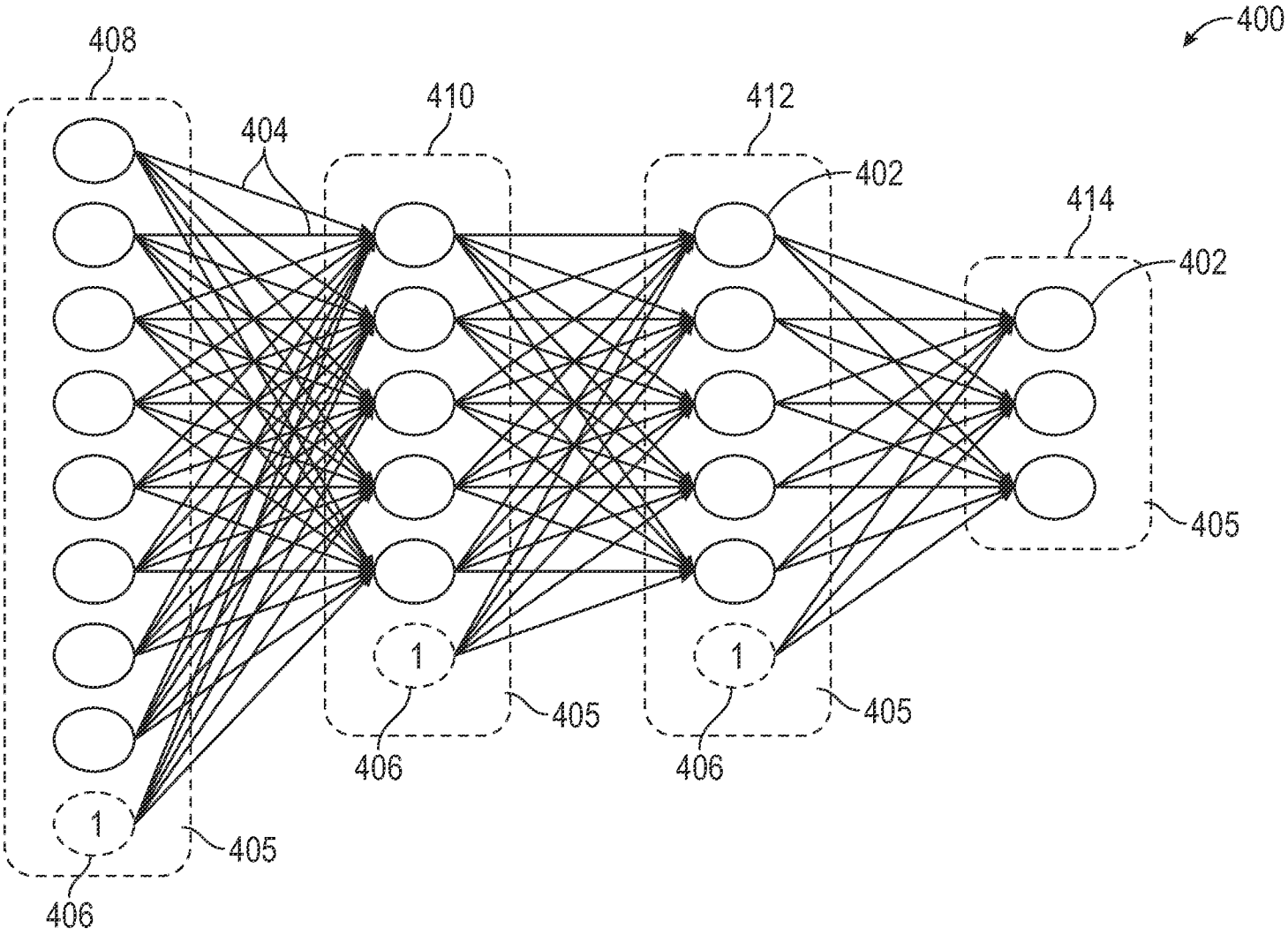
FIG. 4 shows a neural network according to one or more embodiments.

FIG. 4 shows a neural network, a common ML architecture for prediction/inference, which may be used to separate the signals transmitted through the DAS system by multiple autonomous sensors (300) from each other and from background noise. At a high level, a neural network (400) may be graphically depicted as comprising nodes (402), where here any circle represents a node, and edges (404), shown here as directed lines. The nodes (402) may be grouped to form layers (405). FIG. 4 displays four layers (408, 410, 412, 414) of nodes (402) where the nodes (402) are grouped into columns, however, the grouping need not be as shown in FIG. 4. The edges (404) connect the nodes (402). Edges (404) may connect, or not connect, to any node(s) (402) regardless of which layer (405) the node(s) (402) is in. That is, the nodes (402) may be sparsely and residually connected. A neural network (400) will have at least two layers (405), where the first layer (408) is considered the "input layer" and the last layer (414) is the "output layer". Any intermediate layer (410, 412) is usually described as a "hidden layer". A neural network (400) may have zero or more hidden layers (410, 412) and a neural network (400) with at least one hidden layer (410, 412) may be described as a "deep" neural network or as a "deep learning method". In general, a neural network (400) may have more than one node (402) in the output layer (414). In this case the neural network (400) may be referred to as a "multi-target" or "multi-output" network.

Nodes (402) and edges (404) carry additional associations. Namely, every edge is associated with a numerical value. The edge numerical values, or even the edges (404) themselves, are often referred to as "weights" or "parameters". While training a neural network (400), numerical values are assigned to each edge (404). Additionally, every node (402) is associated with a numerical variable and an activation function. Activation functions are not limited to any functional class, but traditionally follow the form:

$$A = f\left(\sum_{i\in(incoming)}[(\text{node value})_i\,(\text{edge value})_i]\right), \qquad \text{Equation (1)}$$

where i is an index that spans the set of "incoming" nodes (402) and edges (404) and $f$ is a user-defined function. Incoming nodes (402) are those that, when viewed as a graph (as in FIG. 4), have directed arrows that point to the node (402) where the numerical value is being computed. Some functions for $f$ may include the linear function $f(x)=x$, sigmoid function $$f(x) = \frac{1}{1+e^{-x}},$$

and rectified linear unit function $f(x)=\max(0, x)$, however, many additional functions are commonly employed. Every node (402) in a neural network (400) may have a different associated activation function. Often, as a shorthand, activation functions are described by the function $f$ by which it is composed. That is, an activation function composed of a linear function $f$ may simply be referred to as a linear activation function without undue ambiguity.

When the neural network (400) receives an input, the input is propagated through the network according to the activation functions and incoming node (402) values and edge (404) values to compute a value for each node (402). That is, the numerical value for each node (402) may change for each received input. Occasionally, nodes (402) are assigned fixed numerical values, such as the value of 1, that are not affected by the input or altered according to edge (404) values and activation functions. Fixed nodes (402) are often referred to as "biases" or "bias nodes" (406), displayed in FIG. 4 with a dashed circle.

In some implementations, the neural network (400) may contain specialized layers (405), such as a normalization layer, or additional connection procedures, like concatenation. One skilled in the art will appreciate that these alterations do not exceed the scope of this disclosure.

As noted, the training procedure for the neural network (400) comprises assigning values to the edges (404). To begin training, the edges (404) are assigned initial values. These values may be assigned randomly, assigned according to a prescribed distribution, assigned manually, or by some other assignment mechanism. Once edge (404) values have been initialized, the neural network (400) may act as a function, such that it may receive inputs and produce an output. As such, at least one input is propagated through the neural network (400) to produce an output. Recall, that a given data set will be composed of inputs and associated target(s), where the target(s) represent the "ground truth", or the otherwise desired output. The neural network (400) output is compared to the associated input data target(s). The comparison of the neural network (400) output to the target(s) is typically performed by a so-called "loss function"; although other names for this comparison function such as "error function" and "cost function" are commonly employed. Many types of loss functions are available, such as the mean-squared-error function, however, the general characteristic of a loss function is that the loss function provides a numerical evaluation of the similarity between the neural network (400) output and the associated target(s). The loss function may also be constructed to impose additional constraints on the values assumed by the edges (404), for example, by adding a penalty term, which may be physics-based, or a regularization term. Generally, the goal of a training procedure is to alter the edge (404) values to promote similarity between the neural network (400) output and associated target(s) over the data set. Thus, the loss function is used to guide changes made to the edge (404) values, typically through a process called "backpropagation".

Figure 5:
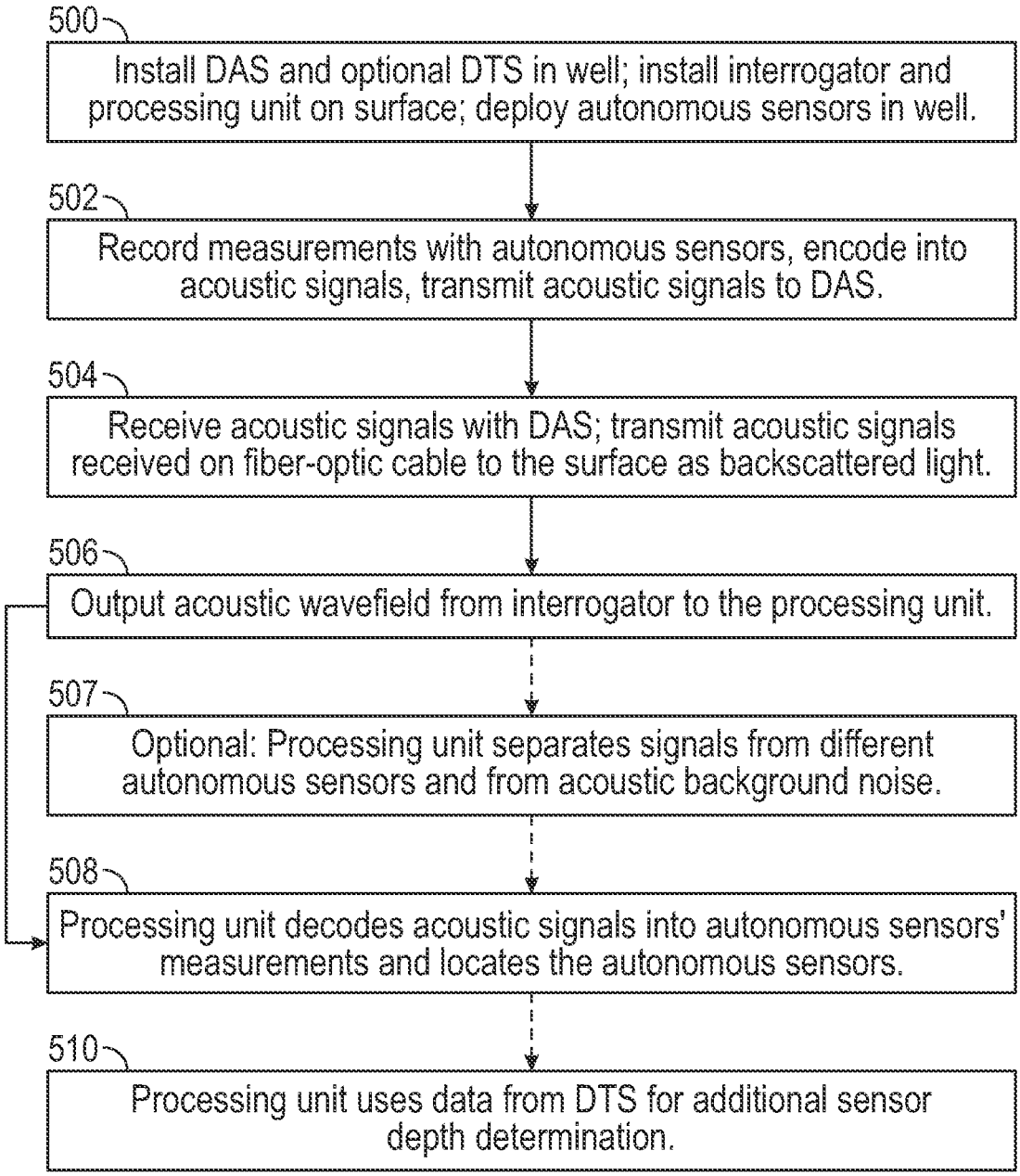
FIG. 5 shows a flowchart for using a DAS system to record and transmit data from autonomous sensors in a borehole, according to one or more embodiments.

FIG. 5 illustrates a flowchart for using the telemetry system disclosed herein. In Step 500, in one or more embodiments, a DAS system and an optional DTS system are installed. Both systems include one or more fiber-optic cables (106) installed in a well (100) and one or more interrogators (110) installed on the surface (101). Furthermore, a processing unit (305) is installed on the surface (101) and may be operatively connected to the interrogator (110), and one or more autonomous sensors (300) with acoustic transmitters are deployed in the borehole (108). The autonomous sensors (300) may, without limitation, either sink down into the well (100) due to gravity or have means of movement such as deployable weights or propellors. In Step 502, the autonomous sensors (300) record data with their internal sensing blocks (304), encode the recordings, and modulate them onto acoustic waves (308) and transmit them to the fiber-optic cable (106) with their internal transmission blocks (306). The recorded data may, without limitation, include measurements of chemical properties, physical properties, and physical fields (electromagnetic, acoustic, pressure, temperature, etc.). The recorded measurements may be encoded onto the acoustic wave (308) using any suitable modulation scheme known in the art (e.g., frequency shift keying, phase shift keying, amplitude shift keying, etc.).

In Step 504, a fiber-optic cable (106) records the transmitted acoustic waves (308) as fiber strain deformations. The interrogator (110) constantly sends light pulses down the fiber-optic cable (106); the fiber strain deformations register as changes in the backscattered light transmitted back to the interrogator (110) at the surface (101) as a function of depth and time. In this way, the recorded measurements taken by the autonomous sensors (300) are first encoded and modulated onto an acoustic wave (308) until it impinges upon the fiber-optic cable (106), at which point the same encoded waveform is modulated upon the signals of backscattered light being reflected up to the surface (101). In Step 506, upon reaching the surface (101), the light signals are processed by an interrogator (110), and an acoustic wavefield (308) is passed to the processing unit (305). Step 507 represents an optional procedure, where the processing unit (305) uses machine learning or other algorithms known to a person of ordinary skill in the art to separate the overlapping acoustic signals of the autonomous sensors (300) from each other, and from the background acoustic noise. In Step 508, the processing unit (305) decodes the acoustic signals to obtain the original recordings/measurements of the autonomous sensors (300) along with their location and their relevant metadata.

In order to obtain the location of the autonomous sensors (300), a positioning procedure must be performed. The autonomous sensor (300) can measure the pressure and transmit it to the surface (101) with the described fiber-optic telemetry system, which allows for estimating the sensor location in the well (100) from the recorded pressure of the liquid column above it. A more accurate estimate of the autonomous sensors' (300) locations can be obtained from the analysis of the DAS system recordings by computation of the acoustic energy envelope along the fiber-optic cable (106) at any given moment and analysis of the amplitudes of such envelope; a simple estimate of the location of an autonomous sensor (300) can be obtained by identifying the energy envelope maxima above a certain threshold. Alternatively, in Step 510, depth can be determined based on matching of the temperature profiles measured by the autonomous sensor (300) and an optionally installed DTS system. The data recorded by the autonomous sensors (300), its modulation and transmission through acoustic waves (308) to the fiber-optic cable (106) and through fiber to the surface (101) occur in parallel, thus enabling almost-real-time data transmission from autonomous sensors (300) to the surface (101) and the localization of the autonomous sensors (300).

Figure 6:
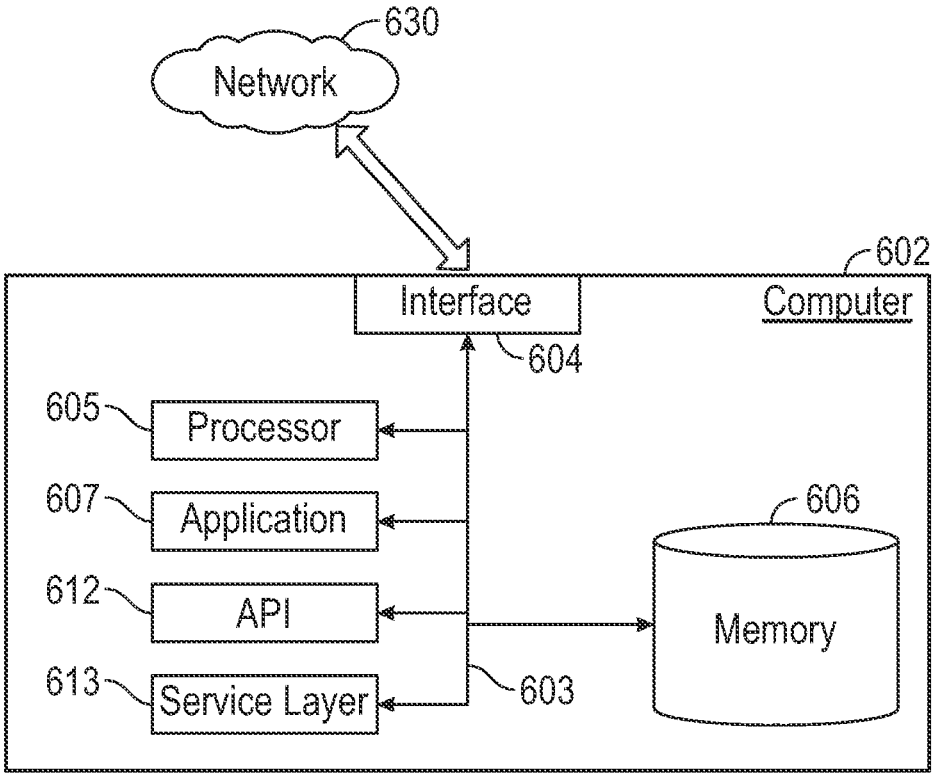
FIG. 6 shows a computer system in accordance with one or more embodiments.

FIG. 6 further depicts a block diagram of a computer system (602) used to provide computational functionalities associated with described algorithms, methods, functions, processes, flows, and procedures as described in this disclosure, according to one or more embodiments. The illustrated computer (602) is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (602) may include a computer that includes an input device, such as a keypad, keyboard, touch screen, or other device that can accept user information, and an output device that conveys information associated with the operation of the computer (602), including digital data, visual, or audio information (or a combination of information), or a GUI.

The computer (602) can serve in a role as a client, network component, a server, a database or other persistency, or any other component (or a combination of roles) of a computer system for performing the subject matter described in the instant disclosure. The illustrated computer (602) is communicably coupled with a network (630). In some implementations, one or more components of the computer (602) may be configured to operate within environments, including cloud-computing-based, local, global, or other environment (or a combination of environments).

At a high level, the computer (602) is an electronic computing device operable to receive, transmit, process, store, or manage data and information associated with the described subject matter. According to some implementations, the computer (602) may also include or be communicably coupled with an application server, e-mail server, web server, caching server, streaming data server, business intelligence (BI) server, or other server (or a combination of servers).

The computer (602) can receive requests over network (630) from a client application (for example, executing on another computer (602) and responding to the received requests by processing the said requests in an appropriate software application. In addition, requests may also be sent to the computer (602) from internal users (for example, from a command console or by other appropriate access method), external or third-parties, other automated applications, as well as any other appropriate entities, individuals, systems, or computers.

Each of the components of the computer (602) can communicate using a system bus (603). In some implementations, any or all of the components of the computer (602), both hardware or software (or a combination of hardware and software), may interface with each other or the interface (604) (or a combination of both) over the system bus (603) using an application programming interface (API) (612) or a service layer (613) (or a combination of the API (612) and service layer (613). The API (612) may include specifications for routines, data structures, and object classes. The API (612) may be either computer-language independent or dependent and refer to a complete interface, a single function, or even a set of APIs. The service layer (613) provides software services to the computer (602) or other components (whether or not illustrated) that are communicably coupled to the computer (602). The functionality of the computer (602) may be accessible for all service consumers using this service layer. Software services, such as those provided by the service layer (613), provide reusable, defined business functionalities through a defined interface. For example, the interface may be software written in JAVA, C++, or other suitable language providing data in extensible markup language (XML) format or another suitable format. While illustrated as an integrated component of the computer (602), alternative implementations may illustrate the API (612) or the service layer (613) as stand-alone components in relation to other components of the computer (602) or other components (whether or not illustrated) that are communicably coupled to the computer (602). Moreover, any or all parts of the API (612) or the service layer (613) may be implemented as child or sub-modules of another software module, enterprise application, or hardware module without departing from the scope of this disclosure.

The computer (602) includes an interface (604). Although illustrated as a single interface (604) in FIG. 6, two or more interfaces (604) may be used according to particular needs, desires, or particular implementations of the computer (602). The interface (604) is used by the computer (602) for communicating with other systems in a distributed environment that are connected to the network (630). Generally, the interface (604) includes logic encoded in software or hardware (or a combination of software and hardware) and operable to communicate with the network (630). More specifically, the interface (604) may include software supporting one or more communication protocols associated with communications such that the network (630) or interface's hardware is operable to communicate physical signals within and outside of the illustrated computer (602).

The computer (602) includes at least one computer processor (605). Although illustrated as a single computer processor (605) in FIG. 6, two or more processors may be used according to particular needs, desires, or particular implementations of the computer (602). Generally, the computer processor (605) executes instructions and manipulates data to perform the operations of the computer (602) and any algorithms, methods, functions, processes, flows, and procedures as described in the instant disclosure.

The computer (602) also includes a memory (606) that holds data for the computer (602) or other components (or a combination of both) that can be connected to the network (630). For example, memory (606) can be a database storing data consistent with this disclosure. Although illustrated as a single memory (606) in FIG. 6, two or more memories may be used according to particular needs, desires, or particular implementations of the computer (602) and the described functionality. While memory (606) is illustrated as an integral component of the computer (602), in alternative implementations, memory (606) can be external to the computer (602).

The application (607) is an algorithmic software engine providing functionality according to particular needs, desires, or particular implementations of the computer (602), particularly with respect to functionality described in this disclosure. For example, application (607) can serve as one or more components, modules, applications, etc. Further, although illustrated as a single application (607), the application (607) may be implemented as multiple applications (607) on the computer (602). In addition, although illustrated as integral to the computer (602), in alternative implementations, the application (607) can be external to the computer (602).

There may be any number of computers (602) associated with, or external to, a computer system containing computer (602), wherein each computer (602) communicates over network (630). Further, the term "client," "user," and other appropriate terminology may be used interchangeably as appropriate without departing from the scope of this disclosure. Moreover, this disclosure contemplates that many users may use one computer (602), or that one user may use multiple computers (602).

Advantageously, embodiments disclosed herein provide a method for conducting fiber-optic telemetry for locating of autonomous sensing devices and data transmission from such devices in a well (100). The method involves joint use of untethered sensing devices and an installed distributed acoustic sensing system and enables the real-time or almost-real-time transmission of the recordings from the autonomous sensing devices to the fiber-optic system's interrogator (110). Due to a unique use of distributed fiber optic system as telemetry, the solution proposed herein allows data retrieval from an untethered downhole sensor in real-time and the localization of the sensor, provided a fiber-optic cable (106) is installed either behind the casing (104) or on production tubing (206). Thus, embodiments disclosed herein allow for real-time sensing without complex deployment. The exact application depends on the sensors installed in the sensing device used and include, but are not limited to, measurements of the physical and chemical properties of the fluid, measurements of physical fields in the well (100), etc.

Although only a few example embodiments have been described in detail above, those skilled in the art will readily appreciate that many modifications are possible in the example embodiments without materially departing from this invention.

What is claimed:

1. A method for fiber-optic telemetry and autonomous sensor localization, comprising:

installing a Distributed Acoustic Sensor (DAS) system in a borehole comprising at least one fiber-optic cable connected to at least one corresponding interrogator;

deploying at least one autonomous sensor;

conducting at least one measurement by the at least one autonomous sensor;

encoding the at least one measurement in at least one encoded acoustic signal;

transmitting the at least one encoded acoustic signal from the at least one autonomous sensor to the at least one fiber-optic cable, wherein the at least one encoded acoustic signal comprises the at least one measurement;

detecting the at least one encoded acoustic signal with the DAS system;

recording the at least one encoded acoustic signal received by the DAS system at a surface location; and processing the at least one encoded acoustic signal with a processing unit to decode and obtain the at least one measurement conducted by the at least one autonomous sensor and at least one location of the at least one autonomous sensor, wherein a distributed temperature sensor (DTS) system is used for an additional sensor depth determination by matching a temperature profile recorded by the DTS system with a temperature transmitted by the at least one autonomous sensor in the at least one encoded acoustic signal.

2. The method of claim 1, wherein the at least one fiber-optic cable of the DAS system is cemented in an annulus between a well casing and the borehole, attached to a production tubing, or hanging inside the borehole.

3. The method of claim 1, wherein the at least one autonomous sensor is deployed inside the borehole or cemented in an annulus between a well casing and the borehole.

4. The method of claim 1, wherein a machine learning system is used to separate the at least one encoded acoustic signal from each other and from a background acoustic noise.

5. The method of claim 1, wherein a cross-correlation analysis of the at least one encoded acoustic signal in time is performed to determine an average velocity of a multiphase fluid in a well.

6. A non-transitory computer readable medium storing instructions executable by a computer processor, the instructions comprising functionality for:

conducting at least one measurement by at least one autonomous sensor;

encoding the at least one measurement in at least one encoded acoustic signal;

transmitting the at least one encoded acoustic signal from the at least one autonomous sensor to at least one fiber-optic cable of a Distributed Acoustic Sensor (DAS) system, wherein the at least one encoded acoustic signal comprises the at least one measurement;

detecting the at least one encoded acoustic signal with the DAS system;

recording the at least one encoded acoustic signal received by the DAS system at a surface location; and processing the at least one encoded acoustic signal with a processing unit to decode and obtain the at least one measurement conducted by the at least one autonomous sensor and at least one location of the at least one autonomous sensor, wherein a distributed temperature sensor (DTS) system is used for an additional sensor depth determination by matching a temperature profile recorded by the DTS system with a temperature transmitted by the at least one autonomous sensor in the at least one encoded acoustic signal.

7. The non-transitory computer readable medium of claim 6, wherein a cross-correlation analysis of the at least one encoded acoustic signal in time is performed to determine an average velocity of a multiphase fluid in a well.

8. The non-transitory computer readable medium of claim 6, wherein a machine learning algorithm is used to separate the at least one encoded acoustic signal from each other and from a background acoustic noise.

9. The non-transitory computer readable medium of claim 8, wherein the machine learning algorithm is a neural network.

10. A system comprising:

a Distributed Acoustic Sensor (DAS) system comprising a first fiber-optic cable installed in a borehole and connected to a first corresponding interrogator, the DAS system being configured to record at least one encoded acoustic signal deforming a fiber in the first fiber-optic cable;

at least one autonomous sensor comprising an acoustic transmitter and being configured to conduct at least one measurement in the borehole, wherein the acoustic transmitter transmits an encoded acoustic signal comprising the at least one measurement to the DAS system;

a distributed temperature sensor (DTS) system comprising a second fiber-optic cable installed in a borehole connected to a second corresponding interrogator, the DTS system being configured to record a temperature, wherein the DTS system is used for an additional sensor depth determination by matching a temperature profile recorded by the DTS system with a temperature transmitted by the at least one autonomous sensor in the at least one encoded acoustic signal;

and a processing unit configured to demodulate/decode the at least one encoded acoustic signal and obtain at least one measurement conducted by the at least one autonomous sensor and at least one location of the at least one autonomous sensor.

11. The system of claim 10, wherein the at least one autonomous sensor is physically attached to a location within the borehole.

12. The system of claim 10, wherein the at least one autonomous sensor has a means for independent movement and further comprises a battery and a modulation/encoding block for encoding an acoustic signal emitted by the at least one autonomous sensor.

13. The system of claim 10, wherein the processing unit is configured to separate the at least one encoded acoustic signal from each other and from a background acoustic noise.

14. The system of claim 13, wherein the processing unit employs a machine learning algorithm to separate the at least one encoded acoustic signal from each other and from the background acoustic noise.

15. The system of claim 14, wherein the machine learning algorithm is a neural network.

16. The system of claim 10, wherein the acoustic transmitter is a piezo device.

17. The system of claim 16, where the piezo device is potted in an elastomer for insulation and impedance matching to a plurality of well fluids.

18. The system of claim 10, wherein the first fiber-optic cable of the DAS system is cemented behind a well casing, installed on a production tubing, or hanging inside the borehole.

* * * * *